United States Patent [19]

List

[11] 4,073,372

[45] Feb. 14, 1978

[54] APPARATUS FOR TRANSPORTING CONTAINERS TO AND FROM A WORKING STATION

[76] Inventor: Hans List, Lau-Strasse 51, 7 Stuttgart 70, Germany

[21] Appl. No.: 756,338

[22] Filed: Dec. 22, 1976

[30] Foreign Application Priority Data

Dec. 27, 1975 Germany ..... 2558886

[51] Int. Cl.[2] ..... B23Q 7/16

[52] U.S. Cl. ..... 198/341; 198/345; 198/427; 198/441; 198/447; 198/458; 53/282; 141/169

[58] Field of Search ..... 198/339, 341, 345, 426, 198/427, 437, 441, 447, 458, 466, 480, 481, 722, 723, 803; 141/169, 186; 53/55, 282

[56] References Cited

U.S. PATENT DOCUMENTS

| | | | |
|---|---|---|---|
| 2,466,962 | 4/1949 | Weymouth | 198/441 |
| 3,238,979 | 3/1966 | Richter et al. | 141/169 |
| 3,283,471 | 11/1966 | Thurston et al. | 53/55 |
| 3,415,036 | 12/1968 | Beckers | 53/282 |

*Primary Examiner*—John J. Love
*Assistant Examiner*—Joseph E. Valenza
*Attorney, Agent, or Firm*—Michael J. Striker

[57] ABSTRACT

Apparatus for transporting containers to and from a working station comprises at least one intermittently rotatable transporting disc provided with a plurality of circumferentially spaced cutouts, which preferably extend in radial direction from the periphery of the transporting disc into the latter, and having each a length to receive two containers, while providing a clearance space for moving the containers in radial direction away from each other. The apparatus includes further means for feeding the containers into the cutouts, means, spaced in circumferential direction of the transporting disc from the feeding means, to discharge the containers from the cutouts, a working station between the feeding and the discharging means, and guide means for moving the containers in each cutout, during their movement from the feeding means to the working station, to space the containers at a predetermined distance from each other necessary for an operation to be performed thereon at the working station.

12 Claims, 3 Drawing Figures

APPARATUS FOR TRANSPORTING CONTAINERS TO AND FROM A WORKING STATION

BACKGROUND OF THE INVENTION

Apparatus for the transport of containers to a working station in form of a filling and/or closure arrangement are known, which comprise an intermittently rotatable transport disc which, in the region of its periphery is provided with a plurality of cutouts, each of which is constructed to receive a single container. The transport of the containers to the intermittently rotatable transport disc is usually constructed as a continuously moving band conveyor. After filling and/or closing the container at the working station, the containers are removed from the cutouts of the transport disc by a continuously operated other band conveyor and guided to the next working station.

All of the known transporting apparatus of the aforementioned kind are characterized in that the cutouts at the periphery of the transport disc are constructed for receiving only a single container.

This feature of the known transporting apparatus in which only a single container may be operated on per working cycle of the apparatus permits only a relatively small output of maximal 80 containers per minute. If a higher output is desired, then this could be obtained only by a continuously rotating transporting disc and elements cooperating therewith, but the manufacturing cost of such an apparatus is considerably higher than that of an apparatus including an intermittently rotatable transporting disc.

SUMMARY OF THE INVENTION

It is an object of the present invention to provide for an apparatus for transporting containers to and from a working station by means of which a high output can be obtained, while the apparatus is of simple construction so as to be producible at relatively small cost and to stand up propertly under extended use.

With these and other objects in view, which will become apparent as the description proceeds, the apparatus according to the present invention for transporting containers to and from a working station mainly comprises intermittently rotatable transporting disc means provided with a plurality of cutouts extending from the periphery of the transport disc means into the latter and dimensioned to each receive at least two containers with a clearance to space the containers in the direction of the cutouts, means for feeding the containers into the cutout, means spaced from the feeding means in circumferential direction of the transporting disc for discharging the containers from the cutouts, a working station between the feeding means and the discharging means, and guide means for moving the containers in each cutout during their movement from the feeding means to the working station away from each other to space the same at a predetermined distance from each other necessary for an operation to be performed at the working station.

The cutouts in the transport disc or discs extend preferably in radial direction, and the guide means may comprise a stationary bow-shaped wedge member, having a width increasing in the direction of rotation of the transport disc, and at least one stationary cam disc radially inwardly spaced from the wedge member and having a cam curve conforming to the inner radius of the wedge member. According to a further feature of the present invention, the wedge member is at least in the region of the working station constructed by two resilient tongues, which are spaced from each other and which respectively engage the two containers in the respective cutout. This will assure that the containers may move within limits in radial direction of the transporting disc to thus follow a centralizing action of the elements in the working station. The working station may be constituted by a device for filling the containers and/or for closing the same.

The novel features which are considered as characteristic for the invention are set forth in particular in the appended claims. The invention itself, however, both as to its construction and its method of operation, together with additional objects and advantages thereof, will be best understood from the collecting description of specific embodiments when read in connection with the accompanying drawing.

DESCRIPTION OF THE PREFERRED EMBODIMENTS

Figure 1:
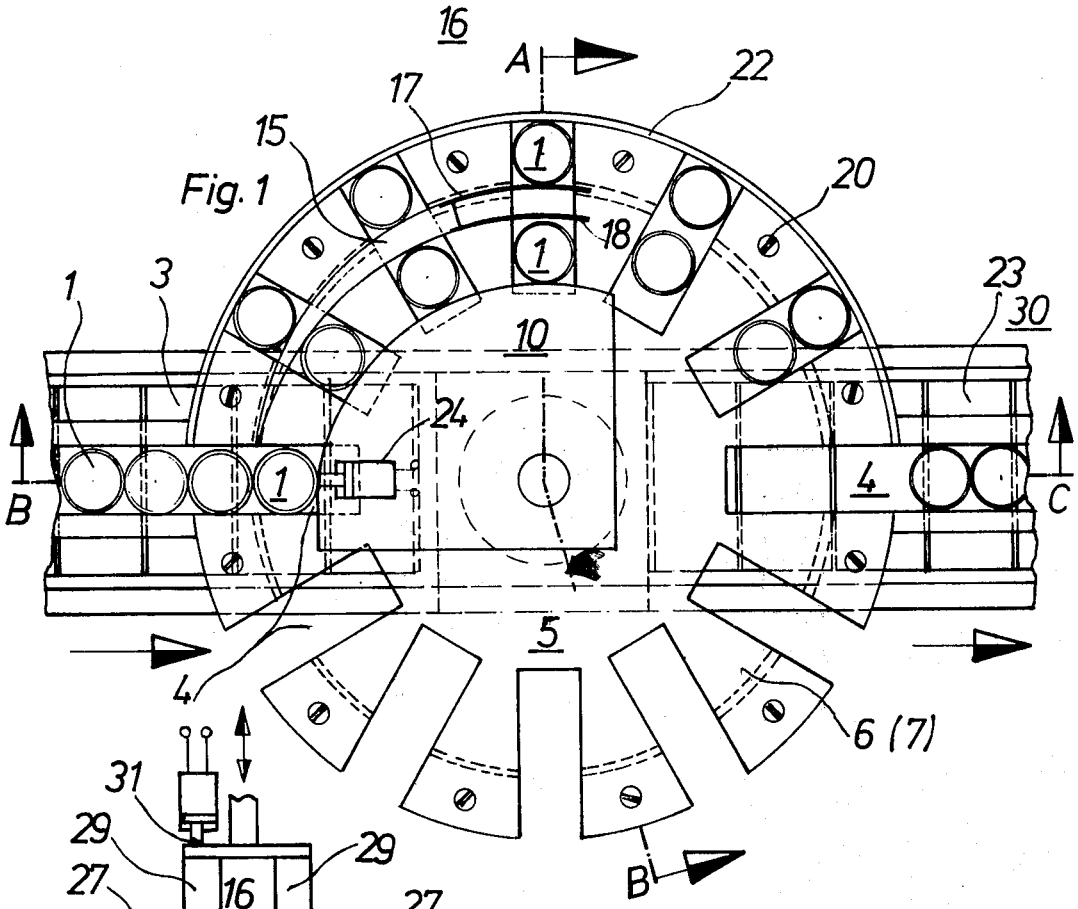
FIG. 1 is a top view of the apparatus according to the present invention.
Figure 2:
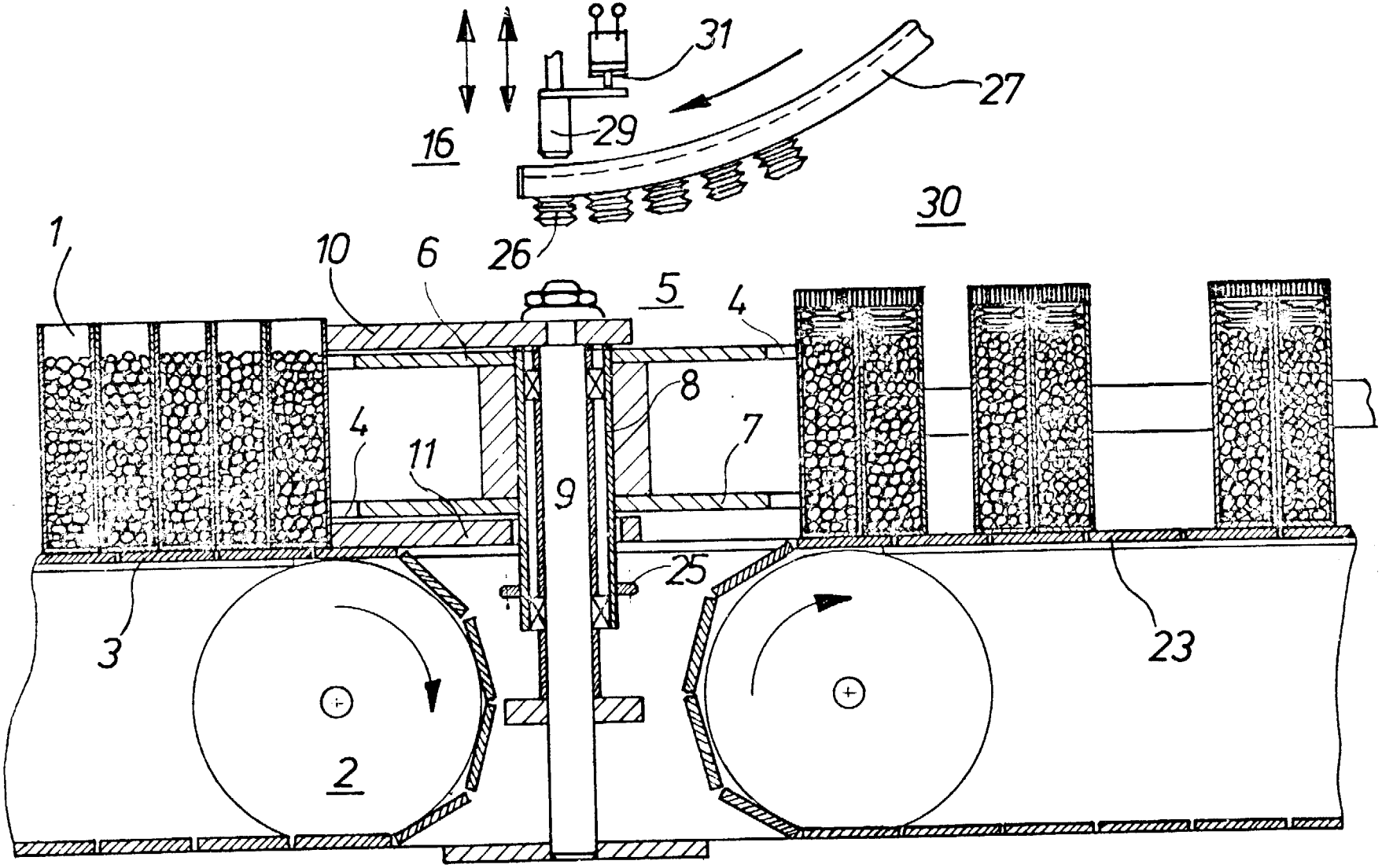
FIG. 2 is a vertical cross-section taken along the line B–C of FIG. 1.

Referring now to the drawing and more specifically to FIGS. 1 and 2 of the same, it will be seen that the apparatus according to the present invention comprises means for feeding containers 1, which may be filled with granulated material, into the cutouts 4 of transporting disc means 5, which are intermittently rotated by drive means, not shown in the drawing, for instance a maltese cross drive. The feed means preferably comprise an endless plate conveyor, only partly shown in FIG. 2, which extends over a reversing roll 2, which may be driven in the direction as indicated by the arrow.

The transport disc means 5 comprises an upper disc 6 and a lower disc 7, each of which is formed with a plurality of, preferably radially extending, cutouts 4 circumferentially displaced from each other and having a radial length dimensioned to receive two containers 1, while providing an additional clearance space to permit the containers to move in radial direction away from each other.

The two discs 6 and 7 of the transport disc means 5 are mounted on a hollow shaft 8 for rotation therewith and a stationary bolt 9 passing through the hollow shaft 8 carries at its upper end a cam disc 10, fixed thereto by a screw connection, in a stationary, but releasable position. An identica lower cam disc 11 is pushed over the hollow shaft 8 and secured, in any convenient manner, to a bottom wall 12, as shown in FIG. 3, which in turn is supported by struts 13, 14 for the transport chains 3 and 23.

Coordinated with the two cam discs 10 and 11 is a bow-shaped wedge member 15 arranged radially outwardly of the peripheries of the cam discs. As shown in FIG. 3, the wedge member 15 is connected to the bottom wall 12, upwardly spaced therefrom. In the region of the working station 16, the bow-shaped wedge member comprises a pair of resilient lamellae 17 and 18, which may be from appropriate plastic material or spring steel, and which permit the containers 1 in the respective cutout 4 to adjust their position relative to each other within certain limits. The lamellae 17 and 18 may diverge or from a continuation of the inner and outer surface of the wedge member 15.

Instead of the bow-shaped wedge member 15 connected to the bottom wall 12, it is also possible to replace this part of the guide means by tracks in the bottom wall 12, separated by a curved wedge-shaped intermediate portion or correspondingly curved tracks, which will provide in connection with eventually in position, form and numbers slightly modified cam discs a proper guide for the containers.

Figure 3:
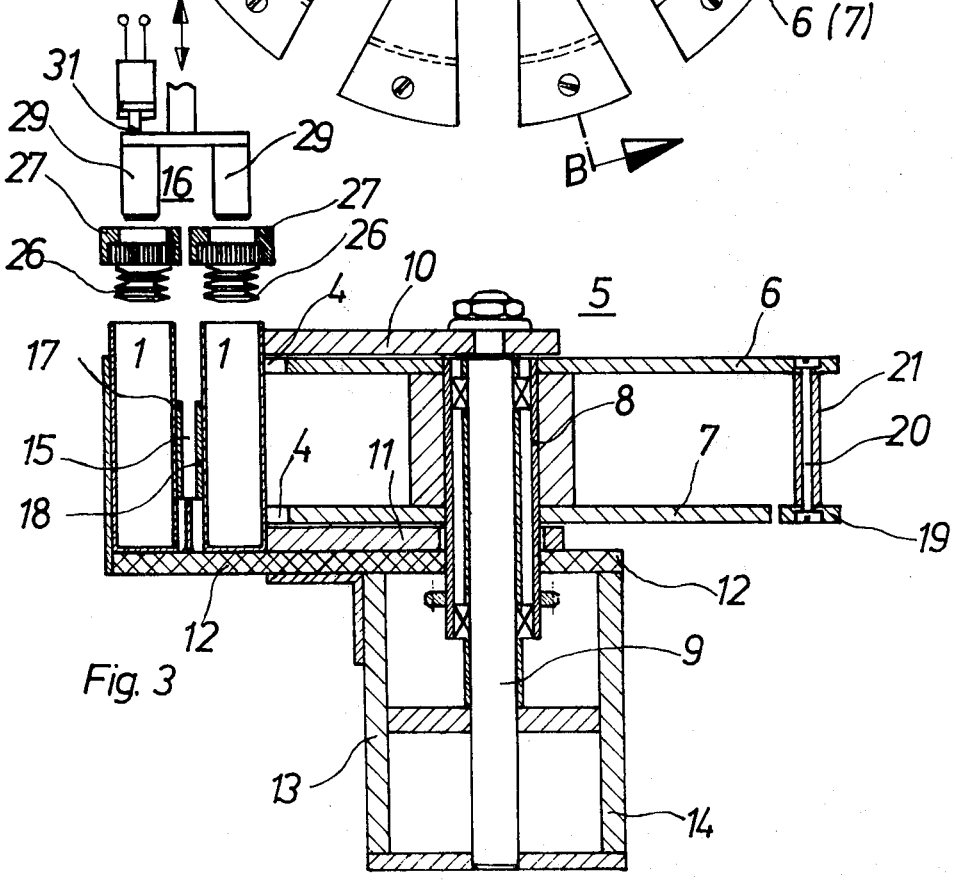
FIG. 3 is a vertical cross-section taken along the line A–B of FIG. 1.
Figure 4:
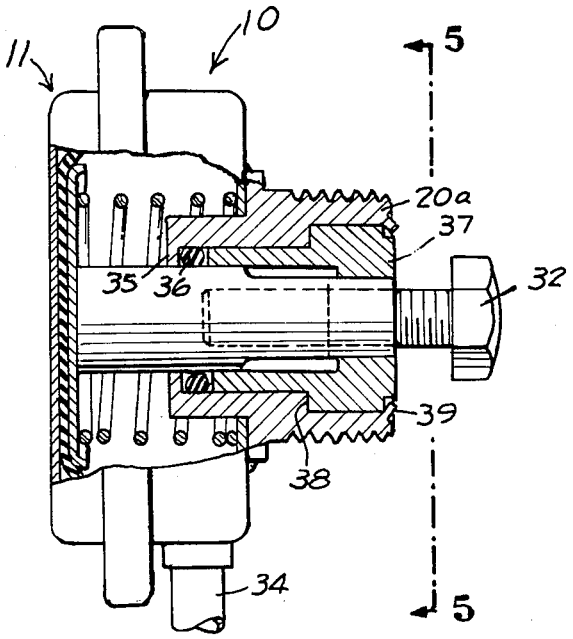
Figure 5:
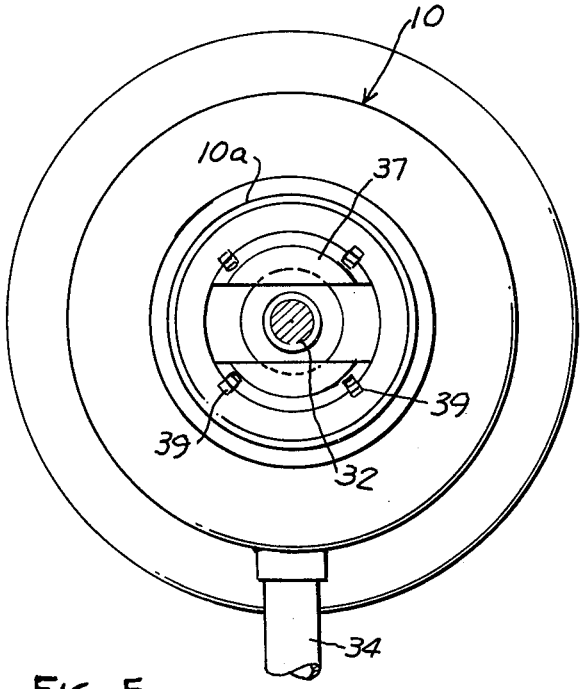

As shown in FIG. 3, the upper disc 6 of the transport disc means 5 is connected to an annular plate member 19 by means of screws 20 and tubular spacer elements 21, to leave between the annular member 19 and the outer periphery of the lower disc 7 a small annular space, through which the web supporting the wedge-shaped member 15 can extend. Means are further provided for limiting the radial outward movement of the containers, and such means preferably comprise a cylindrical casing section 22 extending in circumferential direction of the transporting disc means 5 between the feeding means and the discharging means 30. The discharging means 30 are likewise constituted by an endless plate conveyor 23, only partially shown in FIG. 2, and extending over a reversing roll, which may be driven in the direction as indicated by the arrow in FIG. 2.

The above-described apparatus will be operated as follows:

The conveyor 3 feeds the containers 1 in abutting relationship towards the transport disc means 5 so that the two front containers are pushed by the following containers in one of the cutouts 4, which at this time is aligned with the feeding means. As soon as the leading container engages the cam discs 10, 11, it trips also a contact 24, which initiates the drive of the transporting disc means 5 for the next step of the intermittent movement thereof. While the contact 24 is shown in the drawing as a mechanically operated switch, it is evidently also possible to use instead photoelectric means.

During the next step of the intermediate movement of the transport means 5, the two containers in the respective cutout 4 are moved under the action of the wedge member 15 away from each other, whereby the radially inner container is pushed in radial direction, as far as the cam discs 10, 11 will permit, the radius of which decreases in direction of rotation of the transport disc means 5 in correspondence with the increasing width of the wedge member 15. As mentioned before, the radial length of each cutout is great enough to permit such movement.

At the working station 16, which is located between the feeding means and the discharging means 30 and which is shown in the drawing as a station for closing filled containers, the two containers, in the respective cutout which is aligned with the closure station 16, are spaced from each other a necessary distance so that closure elements in form of caps 26 may be placed into the upper open ends of the containers 1, whereby the latter may slightly change their relative position under the influence of the resilient lamellae 17 and 18. The closure members 26 may be fed to the working station 16 by guide rails 27, schematically shown in FIG. 2, to be pushed into the open ends of the containers by a pair of plungers 29 reciprocatable in the direction of the double headed arrows shown in FIGS. 2 and 3 by conventional drive means, not illustrated in the drawing. In order to assure that the next step of the intermittent movement of the transported disc means 5 can be initiated only after the closing operation has been finished and the plungers 29 have again returned to their uppermost position as shown in FIG. 3, an additional contact 31 is provided, which is closed when the plungers 29 reach their uppermost position, to assure that the next step of intermittent movement can occur only, even if the contact 24 has been actuated before the contact 31, the contacts 24 and 31 are electrically connected by an AND-circuit.

After the closing operation of the containers has been finished, the containers 1 are stepwise fed to the discharging station 30, at which they are transported by the conveyor 23 out of the respective cutout 4 and moved to a further working station, not shown in the drawing, which may, for instance, be a station for the application of labels to the container.

If empty containers are fed by the feeding means into the cutouts 4, the working station may be constituted as a filling station.

It is also possible to increase the width of the cutouts 4 so that two containers adjacent each other may be fed thereinto, while retaining the radial length of the cutouts, so that four containers may be closed during each working cycle of the apparatus, whereby the output of the same is correspondingly increased.

It will be understood that each of the elements described above, or two or more together, may also find a useful application in other types of apparatus for transporting containers to and from a working station differing from the types described above.

While the invention has been illustrated and described as embodied in an apparatus for transporting containers to and from a working station in which empty containers may be filled or filled containers may be closed, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. Apparatus for transporting containers to and from a working station comprising intermittently rotatable transport disc means provided with a plurality of cutouts extending from the periphery of the transporting disc means into the latter and dimensioned to each receive at least two containers with clearance to space the containers in the direction of the cutout from each other; means for feeding the containers into said cutouts; means spaced from said feeding means in circumferential direction of said transporting disc means for discharging said containers from said cutouts; a working station between said feeding means and said discharging means; and guide means for moving the containers in each cutout during their movement from said feeding means to said working station away from each other to space the same at a predetermined distance from each other as necessary for the operation to be performed at the working station.

2. Apparatus as defined in claim 1, wherein said cutouts extend in radial direction of said transport disc means.

3. Apparatus as defined in claim 2, wherein said guide means comprise a stationary bow-shaped wedge member having a width increasing in the direction of rotation of said transporting disc means.

4. Apparatus as defined in claim 3, wherein said guide means further comprises at least one stationary cam disc radially inwardly spaced from said wedge member.

5. Apparatus as defined in claim 4, wherein the radius of said cam disc decreases in correspondence with the increase of the width of said wedge member.

6. Apparatus as defined in claim 5, and including means for limiting radial outward movement of the radially outer container in each cutout.

7. Apparatus as defined in claim 6, wherein said limiting means comprises a cylindrical casing section extending in circumferential direction of said transporting disc means between said feeding means and said discharging means.

8. Apparatus as defined in claim 7, wherein the radius of curvature of said casing section conforms to the outer radius of curvature of the bow-shaped wedge member.

9. Apparatus as defined in claim 3, wherein said bow-shaped wedge member comprises in the region of said working station a pair of resilient lamellae.

10. Apparatus as defined in claim 1, and including contact means in the region of one of said cutouts, which during the intermittent movement of said transporting disc means is substantially aligned with said feeding means to be tripped by the leading container fed by said feeding means, said contact means being constructed to release a drive for said transporting disc means for the next step of the intermittent movement thereof.

11. Apparatus as defined in claim 10, wherein said working station includes a movable element and additional contact means engaged by the latter at a predetermined position of said movable element, said additional contact means being connected by an AND-circuit to said first mentioned contact means to permit rotation of said cam disc means only after the additional contact means is contacted by said movable element.

12. Apparatus as defined in claim 2, wherein said guide means comprise cam tracks deviating from each other in direction of rotation of said transporting means.

* * * * *

UNITED STATES PATENT OFFICE

CERTIFICATE OF CORRECTION

Patent No. 4,073,372 Dated February 14, 1978

Inventor(s) Hans List

It is certified that error appears in the above-identified patent and that said Letters Patent are hereby corrected as shown below:

Sheet 2 of the drawings should be deleted and substituted with the attached sheet therefor.

Signed and Sealed this

*Tenth* Day of *October 1978*

[SEAL]

*Attest:*

RUTH C. MASON
*Attesting Officer*

DONALD W. BANNER
*Commissioner of Patents and Trademarks*